United States Patent [19]

Fukuda et al.

[11] Patent Number: 4,883,379

[45] Date of Patent: Nov. 28, 1989

[54] CORRECTION SHEET AND CORRECTION METHOD

[75] Inventors: Tsuguhiro Fukuda; Hiroshi Sato; Kazuhiro Nakajima, all of Yokohama, Japan

[73] Assignee: Canon Kabushiki Kaisha, Tokyo, Japan

[21] Appl. No.: 162,993

[22] Filed: Mar. 2, 1988

[30] Foreign Application Priority Data

Mar. 2, 1987 [JP] Japan ..... 62-048585
May 27, 1987 [JP] Japan ..... 62-131003

[51] Int. Cl.[4] ..... B41M 5/26

[52] U.S. Cl. ..... 400/697.1; 400/240.1; 427/141; 427/264; 427/265; 428/195; 428/212; 428/346; 428/354; 428/484; 428/488.1; 428/488.4; 428/500; 428/913; 428/914

[58] Field of Search ..... 428/195, 212, 488.1, 428/488.4, 484, 913, 924, 346, 354, 500; 400/240.1; 427/141

[56] References Cited

U.S. PATENT DOCUMENTS 4,453,839 6/1984 Findlay et al. ..... 428/913

*Primary Examiner*—Ellis P. Robinson
*Assistant Examiner*—P. R. Schwartz
*Attorney, Agent, or Firm*—Fitzpatrick, Cella, Harper & Scinto

[57] ABSTRACT

An erroneously recorded image among recorded images on a recording medium is corrected by a correction sheet comprising an adhesive layer on a support. The adhesive layer is heated to develop an adhesive force and caused to adhere to the error image and peel the error image when the correction sheet is separated from the recording medium. The adhesive layer comprises a laminate structure including a separation prevention layer and an upper layer, and the separation prevention layer is in charge of cohesion strength, intimate adhesion to support and flexibility under heating of the adhesive layer. Because of the laminate adhesive layer structure, the correction sheet allows for adequate correction of an error image even on a recording medium with poor surface smoothness without causing correction failure, such as reverse transfer.

8 Claims, 2 Drawing Sheets

CORRECTION SHEET AND CORRECTION METHOD

FIELD OF THE INVENTION AND RELATED ART

The present invention relates to a correction sheet for correcting erroneously recorded images on a recording medium and a correction method using the correction sheet.

With the rapid progress of the information industries, various information processing systems have been developed, and various recording methods and devices suited for the respective information processing systems have been developed and adopted. Recently, the thermal (or heat-sensitive) transfer recording method and the pressure (-sensitive) transfer recording method have been widely used.

However, the thermal transfer recording method and the pressure transfer recording method still involve some drawbacks to be remedied. One of the drawbacks is that a transfer-recorded image is not easily erased even if it is recorded erroneously.

One method for correction of erroneously recorded images or error images in general is to use a hiding paint. This method has been widely used in recent years. The use of such a paint, however, requires a painting operation, as a matter of course, which may not be appropriate under certain circumstances. Especially in the thermal transfer recording, it is sometimes desirable to correct an error image, immediately after it is found, on a transfer recording apparatus, whereas painting of the ink on the transfer recording apparatus is not appropriate. It has also been proposed to use a thermal transfer material having a thermal transfer ink layer containing a hiding colorant of substantially the same color as the recording medium and to cover an error image with the transfer ink layer. By using this method, it is possible to correct an error image as soon as it is found on a transfer recording apparatus. It is however difficult to use a colorant having exactly the same color as the recording medium, and the corrected portion is liable to become somewhat convex by coverage with the ink layer and is readily noticeable to provide an undesirable appearance.

As correction methods free from such difficulties, there have been proposed methods of peeling through adhesion of an erroneously recorded image on a recording medium by using a heat-sensitive adhesive tape (JP-A (Kohkai) 57-98367 and JP-A 62-18292).

However, a conventional heat-sensitive adhesive tape comprises one adhesive layer, and it has been very difficult to provide for one adhesive layer to properly adhere to both the error image and the support or substrate. More specifically, if the adhesion (strength) between the adhesive layer and the support is satisfied, the adhesion between the adhesive layer and the error image is liable to be insufficient. Alternatively, if the adhesion between the adhesive layer and the error image is satisfied, the adhesion between the adhesive layer and the support is liable to be insufficient. Moreover, when an error image printed on a recording medium with a low surface smoothness is peeled by a heat-sensitive adhesive tape, correction is only incompletely performed because the adhesive layer of the correction tape cannot fully follow the surface unevenness and only a portion of an error image formed on a convexity is peeled to leave a portion of the image formed in a concavity unpeeled.

In order to obviate the above difficulties, it may be conceived to use a correction tape having an adhesive layer of an increased thickness so as to increase the contact area with the error image. In case of a correction tape with a thick adhesive layer, however, when a thermal energy sufficient to cause the adhesive layer surface to develop a sufficient adhesiveness, a portion of the adhesive layer close to the support is completely melted or softened to lower its adhesion to the support because of a temperature gradient in the thickness direction. As a result, the adhesive layer is transferred to the recording medium (reverse transfer), thus resulting in failure of correction.

SUMMARY OF THE INVENTION

An object of the present invention is to overcome the above difficulties of the prior art and provide a correction tape having a sufficient adhesion to both an error image and the support, following an error image formed on even a recording medium with a low surface smoothness to increase the contact area and not causing reverse transfer.

According to the present invention, there is provided a correction sheet, comprising an adhesive layer disposed on a support, so that the adhesive layer develops an adhesive force on heating to adhere onto an erroneously recorded image on a recording medium, followed by peeling of the erroneously recorded image from the recording medium together with adhesive layer; wherein the adhesive layer comprises a separation prevention layer and an upper layer developing an adhesion on heating.

As a result of our study for accomplishing the above object, we have found it difficult to remove the above difficulties of the prior art by a single adhesive layer and have found it effective to dispose between the adhesive layer and the support an additional adhesive layer comprising preferably a thermoplastic resin and ensuring intimate contact with the support. Further, the additional adhesive layer has enough flexibility to follow an error image formed on a recording medium of a poor surface smoothness to increase the adhesion area, and allows for suitable correction without causing reverse transfer because of its cohesive force.

These and other objects, features and advantages of the present invention will become more apparent upon a consideration of the following description of the preferred embodiments of the present invention taken in conjunction with the accompanying drawings, wherein like parts are denoted by like reference numerals. In the description appearing hereinafter, "part(s)" and "%" used for describing quantities are by weight unless otherwise noted specifically.

DETAILED DESCRIPTION OF THE INVENTION

Figure 1:
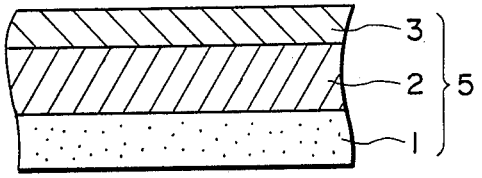
FIG. 1 is a schematic sectional view across the thickness of an embodiment of the correction sheet according to the present invention.

Referring to FIG. 1, a correction sheet 5 according to the present invention comprises a support 1, and a laminate adhesive layer including a separation prevention layer 2 and an upper layer 3 disposed in that order on the support 1. More specifically, in the correction sheet 5 according to the present invention, the adhesive layer is separated into the separation prevention layer 2 and the upper layer 3, the separation prevention layer 2 being in charge of intimate contact or adhesion with the support and upper layer 3 being in charge of adhesion with a recording medium.

As the support 1, known film and paper may be used as they are. For example, there may be suitably used a film of a plastic material having a relatively good heat-resistance, such as polyestter, polycarbonate, triacetylcellulose, nylon, polyimide, etc; cellophane, parchment paper, and capacitor paper. The thickness of the support may preferably be on the order of 1–15 microns, where an error image is peeled through bonding with heat and a thermal head is used as the heat source. However, the thickness need not be restricted particularly if a heat source, such as laser beam, capable of selectively heating the correction sheet, particularly the adhesive layer, according to the present invention is used. Further, when a thermal head is used, the surface of a support contacting the thermal head can be coated with a heat-resistant protective layer of, e.g., silicone resin, fluorine resin, urethane resin, polyimide resin, epoxy resin, phenolic resin melamine resin, and nitrocellulose so as to improve the heat-resistance of the support or to allow the use of a support material which has not been used heretofore.

The separation prevention layer 2 may preferably be not completely melted, even if it is softened, on heating so as to avoid a decrease in adhesion with the support 1. Further, it is preferred that the separation prevention layer 2 has a flexibility to some extent so as to follow the uneveness of an error image and ensure a sufficient contact therewith.

For this purpose, the separation prevention layer 2 may comprise a thermoplastic resin showing a large cohesion and also a large adhesion under heating. It is preferred that the thermoplastic resin contained in the separation prevention layer 2 has a glass transition temperature of −40° C. to 30° C., particularly −30° C. to 15° C. In case where the thermoplastic resin is a mixture of plural (n) thermoplastic resins, it is preferred that the glass transition temperature $T_{gM}$ of the mixture defined by the following equation (A) is also within the above-defined range:

$$T_{gM} = T_{g1} \times \frac{w_1}{W} + T_{g2} \times \frac{w_2}{W} \ldots + T_{gn} \times \frac{w_n}{W}, \quad \text{(A)}$$

wherein $T_{g1}, \ldots - T_{gn}$ denote the glass transition temperatures of individual thermoplastic resins constituting the thermoplastic resin mixture; W denotes the total weight of the thermoplastic resin mixture; and $w_1, \ldots - w_n$ denote the weights of the individual thermoplastic resins constituting the thermoplastic resin mixture. In other words, in the case where a mixture of plural resins is used as the thermoplastic resin, the thermoplastic resin mixture may be regarded as a single thermoplastic resin if the glass transition temperature of the mixture is defined by the above equation (A). If the glass transition temperature of the thermoplastic resin is too high, the separation prevention layer 2 loses its flexibility and is caused to have a low adhesion with the support. If the glass transition temperature is too low, the separation prevention layer becomes too viscous, thus causing a difficulty in handling.

Further, if the separation prevention layer 2 causes a cohesion failure therein when the correction sheet is peeled from a recording medium, the adhesive layer is left on the recording medium, thus failing to peel the error image off. Accordingly, the separation prevention layer 2 is required to show a large cohesion strength under heating. For a high cohesion strength, it is preferred that the weight-average molecular weight of the thermoplastic resin contained in the separation prevention layer 2 is 10,000 or more, particularly 50,000 or more. The weight-average molecular weight used herein refers to a value measured by GPC (gel permeation chromatography). When the thermoplastic resin is a mixture of plural thermoplastic resins, the weight-average molecular weight refers to that of the mixture thermoplastic resin mixture as a whole.

The thermoplastic resin contained in the separation prevention layer 2 may for example be vinyl acetate-type resin such as vinyl acetate-ethylene copolymer, epoxy-type resin, polyurethane-type resin, acrylic resin, or elastomer such as styrene-butadiene rubber and isoprene rubber. Further, petroleum resin, phenolic resin, melamine-type resin, urea-type resin, or polystyrene-type resin can be further mixed as desired. It is also possible to admix a filler, such as titanium oxide, clay, zinc white or alumina hydrate; a plasticizer, a stabilizer, etc., as desired.

The separation prevention layer 2 may be obtained through appropriate control of the molecular weight and/or crystallinity of the above-mentioned material and/or through mixing of plural species thereof.

It is preferred for the thermoplastic resin constitutes 70–100%, particularly 90–100%, of the separation prevention layer 2.

The thickness of the separation prevention layer 2 may preferably be 1 μm or above in view of the capability of following or fitting the surface uneveness of a recording medium with a poor surface smoothness and 15 μm or below in view of thermal conductivity. A thickness in the range of 2–10 μm is further preferred.

The upper layer 3 may be composed of a material showing an adhesiveness or tackiness, i.e., a heat-sensitive adhesive material, preferably a thermoplastic resin which is compatible with a material constituting an error image and has a glass transition temperature in the range of −130° C. to +40° C.

Examples of materials constituting the upper layer 3 may include: olefinic resin, such as ethylene-vinyl acetate copolymer and ethylene-acrylic acid copolymer; polyamide resins, polyester resins, epoxy resins, polyurethane resins, acrylic resins, styrene resins, vinyl chloride resins, vinyl acetate resins such as vinyl acetate-ethylene copolymer, and elastomers, such as styrene-butadiene rubber and isoprene rubber.

In addition to the above material, it is possible to admix as desired a tackifier, such as rosin, modified rosin, tacky polymer, terpene, modified terpene, coumarone-indene resin, hydrocarbons, chlorinated hydrocarbons, petroleum resin, or phenolic resin; a wax, such as paraffin wax, microcrystalline wax, vegetable wax, or synthetic wax; a plasticizer, such as phthalate, glycolate, polybutene, or mineral oil; a filler, such as tale, baryte or clay; a stabilizer such as hindered phenol; etc.

The upper layer 3 may be obtained through appropriate control of the molecular weight and/or crystallinity, and/or through mixing of plural species, of the above-mentioned material.

It is preferred for the thermoplastic resin constitutes 40–100%, particularly 60–100%, of the upper layer 3.

The upper layer 3 is disposed farther from the heat source than the separation prevention layer 2, so that it does not readily cause cohesion failure therein. In order to further increase the cohesion strength of the upper layer 3, however, it is possible to admix a resin having a glass transition temperature of 60° C. or higher, preferably 80° C. or higher, as desired. Examples of the resin to be used for this purpose may include polyvinyl alcohol, polyvinyl butyral, and polyvinylpyrrolidone. It is preferred that the resin added for increasing the cohesion strength constitutes 1% or more and 25% or less of the upper layer 3, particularly 10% or less when a resin having a glass transition temperature of 80° C. or higher is used.

It is preferred that the upper layer 3 shows a lower melt viscosity than the separation prevention layer 2. In other words, it is preferred that the material forming the upper layer 3 provides a certain melt viscosity, e.g., $3\times10^6$ poise, at a temperature lower by 20° C. or more, particularly 30° C. or more, than the temperature of the material of the separation prevention layer 2 giving the same melt viscosity. Herein, the melt viscosity is based on a value measured by using Shimazu Flow Tester, Model FT 500 under the conditions of die size =1.0 mm-dia ×1 mm-long and a load =30 Kg.

The thickness of the upper layer 3 may preferably be 1–10 μm, particularly 4–8 μm, in view of thermal conductivity.

The correction sheet of the present invention may suitably be formed by preparing an aqueous emulsion of the above-mentioned materials with the addition of a despersant, such as a surfactant, for the respective layers, and applying the emulsions sequentially onto the support.

If the materials constituting the separation prevention layer 2 or the upper layer 3 allows, the materials can be mixed with an organic solvent, such as methyl ethyl ketone, xylene, or tetrahydrofuran to prepare a coating liquid, followed by application thereof to form the respective layers, or the so-called hot-melt coating can be adapted by melting the materials for the respective layers under heating, followed by successive application thereof.

It is also possible to combine the above methods to form the respective layers by using a different method for each layer.

It is further possible to dispose an additional layer between the separation prevention layer 2 and the upper layer 3 in order to enhance the adhesion therebetween or provide another function.

The planar shape of the correction sheet 5 is not particularly limited, but it is generally shaped in the form of a ribbon or tape as of a typewriter ribbon or a wider tape as used in line printers, etc.

Next, a correction method using the correction sheet according to the present invention is explained.

Figure 2:
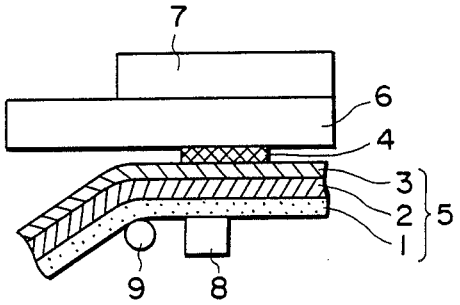
FIGS. 2 and 3 are schematic sectional views of an embodiment of the correction sheet according to the present invention in use.
Figure 3:
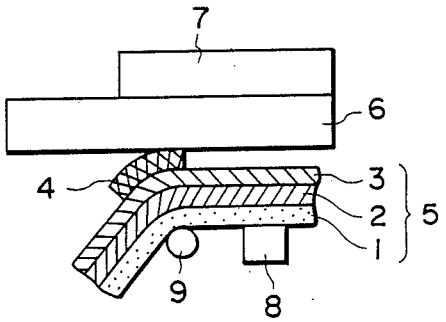

FIGS. 2 and 3 are schematic sectional plan views in use of a correction sheet 5 according to the present invention. The correction sheet 5 in the form of a ribbon is disposed above or below a thermal transfer ribbon for ordinary recording (not shown in FIGS. 2 and 3, which is disposed below or above the correction sheet 5 in the direction of the thickness of the drawing) in a single cassette loading the two stories of ribbons. In order to peel the error image off, the cassette is slided upward or downward so that the correction sheet faces and contacts the error image.

More specifically, when an error image 4 is found on a recording medium 6, a thermal head 8 is moved together with the correction sheet 5 to face the error image 4 and is pressed against the error image 4 by the medium of the correction sheet 5 so that the upper adhesive layer 3 of the correction sheet 5 contacts the error image. Further, while the back face of the recording medium 6 is supported by a platen 7, a heat pulse is applied from the thermal head 8 in the pattern of the error image 4 or in a solid pattern covering the error image 4 (FIG. 2).

When the correction sheet 5 is heated in this way, the separation prevention layer 2 thereof is softened to readily follow the surface unevenness on the recording medium 6 and the upper layer 3 is melted to adhere to the error image 4. Then, the portion of the correction sheet 5 contacting the error image 4 is cooled in contact with a member 9 to recover the cohesion strength of the adhesive layer, and the correction sheet 5 is separated from the recording medium 6 so that the error image 4 is transferred together with the upper layer 3 to the correction sheet 5, thus being peeled from the recording medium 6 (FIG. 3).

In order to satisfactorily effect the above correction procedure, the recorded image 4 should be formed so as not to excessively penterate into the recording medium. It is difficult to completely remove a recorded image having deeply penetrated into a recording medium.

In the above, an embodiment of thermal transfer recording where a thermal head is used as the heat source has been explained, but a similar operation is possible also when another heat source such as laser beam is used.

Hereinbelow, the correction sheet of the present invention is more specifically explained based on examples.

EXAMPLE 1

A 6 μm-thick polyethylene terephthalate film was coated with an emulsion (non-volatile content =40%) of vinyl acetate-ethylene copolymer resin (glass transition temperature ($T_g$) =0° C., weightaverage molecular weight ($M_w$) =779000, ethylene content =20%) by means of an applicator, followed by drying for 1 min. in a hot air drier at 80° C. to form a 4.0 μm-thick separation prevention layer.

Then, on the separation prevention layer was applied an emulsion (nonvolatile content =30%) containing a nonvolatile composition according to Prescription 1 shown below by means of an applicator, followed by drying for 3 min. in a hot air drier at 60° C. to form a 6.0 μm-thick upper layer. Thus, a correction sheet according to the present invention was obtained.

(Prescription 1)

| | |
|---|---|
| Ethylene-vinyl acetate copolymer (ethylene content = 72%, softening point (SP) = 155° C., melt index (MI) = 6) | 70 parts |
| Ester wax | 10 parts |
| Paraffin wax | 15 parts |
| Rosin ester | 5 parts |

EXAMPLE 2

A 6 μm-thick polyethylene terephthalate film was coated with an emulsion of an acrylic resin ($T_g = -14°$ C., $M_w = 84000$, Composition based on polymerization chargestock: ethyl acrylate 92 parts, methyl methacrylate 2 parts, methacrylic acid 3 parts, methacrylamide 3 parts) by means of an applicator, followed by drying for 1 min. in a hot air drier at 75° C. to form a 5.0 μm-thick separation prevention layer.

Then, the separation prevention layer was further coated with a 6.0 μm-thick upper layer of Prescription 1 in the same manner as in Example 1 to obtain a correction sheet according to the invention.

EXAMPLE 3

A 6 μm-thick polyethylene terephthalate film was coated with an emulsion of an acrylic resin ($T_g = \times 33°$ C., $M_w = 193000$, Composition based on polymerization chargestock: ethyl acrylate 48 parts, methyl methacrylate 46 parts, methacrylic acid 3 parts, methacrylamide 3 parts) by means of an applicator, followed by drying for 1 min. in a hot air drier at 70° C. to form a 4.0 μm-thick separation prevention layers.

Then, the separation prevention layer was further coated with a 6.0 μm-thick upper layer of Prescription 1 in the same manner as in Example 1 to obtain a correction sheet according to the invention.

EXAMPLE 4

On a separation prevention layer formed on a 6 μm-thick polyethylene terephthalate film formed in the same manner as in Example 1, an aqueous dispersion (nonvolatile content = 22%) with a nonvolatile composition according to Prescription 2 shown below was applied by means of an applicator, followed by drying for 3 min. in a hot air drier at 55° C. to form a 6.0 μm-thick upper layer. Thus, a correction sheet according to the present invention was obtained.

(Prescription 2)

| | |
|---|---|
| Ethylene-vinyl acetate copolymer resin (ethylene content = 72%, SP = 155° C., MI = 6) | 70 parts |
| Ester wax | 10 parts |
| Paraffin wax | 15 parts |
| Rosin ester | 5 parts |
| Polyvinyl alcohol ($T_g$ = 85° C. (saponification degree = 87–89 mol %, polymerization degree = 1700–1800) | 5 parts |

EXAMPLE 5

On a separation prevention layer formed on a 6 μm-thick polyethylene terephthalate film formed in the same manner as in Example 1, an aqueous dispersion (nonvolatile content = 25%) with a nonvolatile composition according to Prescription 3 shown below was applied by an applicator, followed by drying for 3 min. in a hot air dryer at 55° C. to form a 6 μm-thick upper layer. Thus, a correction sheet according to the present invention was obtained.

(Prescription 3)

| | |
|---|---|
| Ethylene-vinyl acetate copolymer resin (ethylene content = 72%, SP = 155° C., MI = 6) | 70 parts |
| Ester wax | 10 parts |
| Paraffin wax | 15 parts |
| Rosin ester | 5 parts |
| Polyvinyl alcohol ($T_g$ = 85° C.) (saponification degree = 87–89 mol % polymerization degree = 350–400) | 25 parts |

EXAMPLE 6

On a separation prevention layer formed on a 6 μm-thick polyethylene terephthalate film formed in the same manner as in Example 1, an aqueous dispersion (nonvolatile content = 25%) with a nonvolatile composition according to Prescription 4 shown below was applied by an applicator, followed by drying for 3 min. in a hot air drier at 55° C. to form a 6 μm-thick upper layer. Thus, a correction sheet according to the present invention was obtained.

(Prescription 4)

| | |
|---|---|
| Ethylene-vinyl acetate copolymer resin (ethylene content = 72%, SP = 155° C., MI = 6) | 69 parts |
| Ester wax | 10 parts |
| Paraffin wax | 15 parts |
| Rosin ester | 5 parts |
| Polyvinylpyrrolidone ($T_g$ = 86° C.) ("PVP K-90", available from GAF Co.) | 1 part |

EXAMPLE 7

On a separation prevention layer formed on a 6 μm-thick polyethylene terephthalate film formed in the same manner as in Example 1, an aqueous dispersion (nonvolatile content = 22%) with a nonvolatile composition according to Prescription 5 shown below was applied and dried in the same manner as in Example 4 to obtain a correction sheet according to the present invention.

(Prescription 5)

| | |
|---|---|
| Ethylene-vinyl acetate copolymer resin (ethylene content = 72%, SP = 155° C., MI = 6) | 70 parts |
| Ester wax | 10 parts |
| Paraffin wax | 15 parts |
| Rosin ester | 5 parts |
| Polyvinyl alcohol ($T_g$ = 85° C.) (saponification degree = 87–89 mol % polymerization degree = 350–400) | 35 parts |

COMPARATIVE EXAMPLES 1, 2 and 3

A 6 μm-thick polyethylene terephthalate film was coated with a single adhesive layer according to Prescription 1 used in Example 1 in thickness of 2 μm, 6 μm and 10 μm separately to obtain correction sheets of Comparative Examples 1, 2 and 3, respectively.

COMPARATIVE EXAMPLE 4

A 6 μm-thick polyethylene terephthalate film was coated with a 6 μm-thick single adhesive layer according to Prescription 3 used in Example 5.

COMPARATIVE EXAMPLE 5

On a 6 μm-thick polyethylene terephthalate film, an aqueous dispersion (nonvolatile content =25%) with a nonvolatile composition according to Prescription 6 shown below by an applicator, followed by drying to form a 6 μm-thick single adhesive layer.

(Prescription 6)

| | |
|---|---|
| Ethylene-vinyl acetate copolymer resin (ethylene content = 72%, SP = 155° C., MI = 6) | 42 parts |
| Ester wax | 6 parts |
| Paraffin wax | 9 parts |
| Rosin ester | 3 parts |
| Polyvinyl alcohol ($T_g$ = 85° C.) (saponification degree = 87–89 mol % polymerization degree = 350–400) | 40 parts |

(Recording, Error image)

Figure 4:
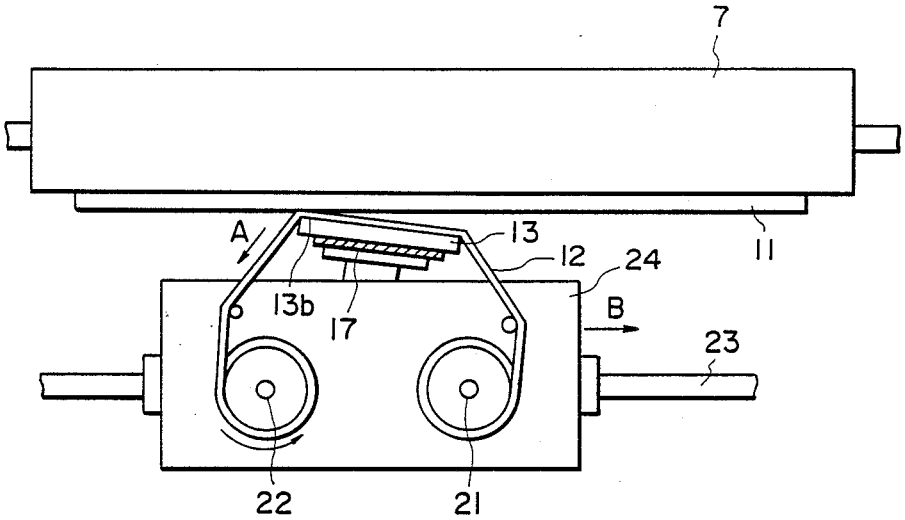
FIG. 4 is a plan view of an apparatus for providing recorded images.
Figure 5:
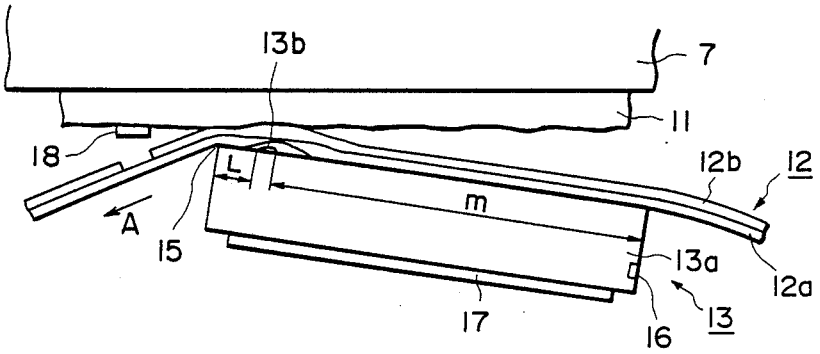
FIG. 5 is a partial enlarged view of a part around the thermal head shown in FIG. 4.

Thermal transfer printing was effected on a smooth paper with a Bekk: smoothness of above 100 sec. and a rough paper with a Bekk smothness of 4–5 sec. by using an apparatus as shown in FIGS. 4 and 5, and a thermal transfer ink ribbon formed with a resin-type ink.

The recording method is explained with reference to FIGS. 4 and 5.

A recording paper 11 as a recording medium is supported on a platen 7, and a thermal transfer ink ribbon 12 having a thermal transfer ink layer 12*b* on a substrate 12*a* is disposed to face the recording paper 11 with its ink layer 12*b* side.

When the ink ribbon 12 is heated above a temperature $T_1$, the ink layer 12*b* is melted or softened to adhere onto the recording paper 11 surface. Thereafter, when the recording paper 11 and the ink ribbon 12 are separated from each other at a peeling position, the heated pattern of the thermal transfer ink layer 12*b* is transferred onto the recording paper 11 to leave thereon a recorded image 18. The pattern heating is effected by a thermal head 13 provided with a heating element 13*b* on a substrate 13*a*. The thermal head 13 is heated by a heater 17 and the temperature of the substrate 13*a* is detected by a temperature detecting element 16. Both ends of the ink ribbon 12 are wound up about a feed roller 21 and a take-up roller 22, and the ink ribbon is successively fed in the direction of an arrow A.

The thermal head 13 is mounted on a carriage 24 and exerts a pressure onto the back platen 7 by the medium of the recording paper 11 and the ink ribbon 12. The carriage 24 is moved along a rail 23 in the direction of an arrow B, and in accordance with the movement, recording is effected on the recording paper 11 by the thermal head 13.

Prior to the recording operation, the heater 17 is energized, and the temperature of the thermal transfer ink layer 12*b* is controlled to a prescribed temperature $T_0$ while monitoring the temperature of the substrate 13*a* by the temperature detecting element 16. The temperature $T_0$ is set to below the transfer initiation temperature $T_1$ of the ink layer 12*b*. Ordinarily, $T_0$ is set to a temperature in the range of 35° C.–60° C., preferably 40° C.–50° C. The ink ribbon 12 is heated to the temperature $T_0$ while moving along the thermal head 13. By this preheating, the temperature distribution of the ink can be moderated to provide a recorded image free from excessive penetration into the recording paper.

(Results of correction)

Recorded images obtained in the above-described manner were corrected in the correction as described before by using the correction sheets of Examples 1–7 and Comparative Examples 1–5 which had been slit into a length of 50 cm. and a width of 8 mm. The results are summerized in the following Table 1.

| | Structure and thickness of adhesive layer | Smooth paper (Bekk smoothness >100 sec) | Rough paper (Bekk smoothness = 4–5 sec) |
|---|---|---|---|
| Example 1 | separation prevention layer 4.0 μm upper layer 6.0 μm | ⊙ | ⊙ |
| Example 2 | separation prevention layer 5.0 μm upper layer 6.0 μm | ⊙ | ⊙ |
| Example 3 | separation prevention layer 4.0 μm upper layer 6.0 μm | ○ | ○ |
| Example 4 | separation prevention layer 4.0 μm upper layer 6.0 μm | ⊙ | ⊙ |
| Example 5 | separation prevention layer 4.0 μm upper layer 6.0 μm | ⊙ | ⊙ |
| Example 6 | separation prevention layer 4.0 μm upper layer 6.0 μm | ⊙ | ⊙ |
| Example 7 | separation prevention layer 4.0 μm upper layer 6.0 μm | ⊙ | ⊙ |
| Comp. Example 1 | 2 μm | ○ | × (partial remaining) |
| Comp. Example 2 | 6 μm | ○ | Δ |
| Comp. Example 3 | 10 μm | × (reverse transfer) | × (Reverse transfer) |
| Comp. Example 4 | 6.0 μm | ○ | Δ |
| Comp. Example 5 | 6.0 μm | Δ | Δ |

Evaluation standards in the above table are as follows.

⊙. . . - Substantially complete removal was effected.

○. . . - Printed image was slightly left but practically of no problem.

Δ. . . - Peeling of printed image was incomplete so that the image was discernible even after the peeling.

X. . . - Peeling of printed image could not be effected.

Figure 6:
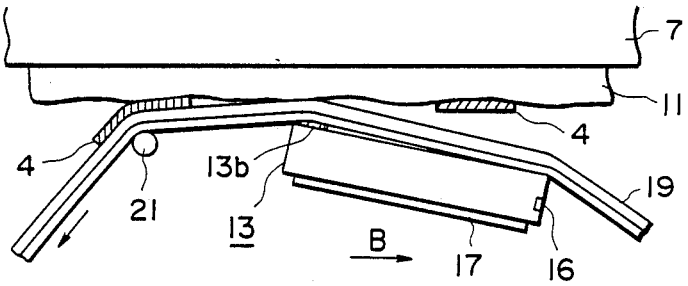
FIG. 6 is a partial view, similar to FIG. 5, illustrating another mode of using a correction sheet according to the present invention.

FIG. 6 illustrates another embodiment of the correction method using the correction sheet according to the present invention. In this method, a peeling member 21 capable of moving toward and away from a platen 7 is used to change the position of peeling between a correction sheet 19 with an at least two adhesive layer-structure and a recording medium 11 depending on whether it is at the time of recording or at the time of correction, and the correction sheet 19 is preliminary heated prior to its contact with an error image 4 and then further heated to adhere the error image.

More specifically, in the method illustrated in FIG. 6, when an error image 4 is to be corrected, the peeling member 21 projected toward the platen 7 to deviate the peeling position of the correction sheet 19 from the rear end of the thermal head 13 as shown in FIG. 6. On the other hand, when printing is effected by using an ink ribbon, the peeling member 21 is left away from the platen 7 and the ink ribbon is peeled at the rear end of the thermal head 13. The thermal head 13 is provided with a heater 17 to heat the thermal head 13 similarly as in the recording method explained with reference to FIG. 5.

When an error image is to be corrected, a correction sheet 19 of the invention disposed below an ink ribbon (not shown) is moved or slided upward (from the back to the front side of the drawing) so as to pass in contact with the heating element **13*b* of the thermal head 13. At this time, the thermal head 13 is temperature-controlled by the heater 17 and the temperature detecting element 16**.

Then, the correction sheet 19 is caused to contact the recording medium 11 by thermal head 13. Simultaneously at this time, the peeling member 21 is projected to press the correction sheet 19 onto the recording medium 11. The peeling member 21 may suitably be mounted on a carriage loading the ink ribbon and the correction sheet.

In this way, while the carriage is moved in the direction of an arrow B, the thermal head is energized to heat the correction sheet 19 in the pattern of the error image 4 or in a solid pattern covering the error image to have the correction sheet 19 adhere to the error image 4. The carriage is further moved in this state. Then, the thermal head 13 and the peeling member 21 are separated from the recording medium 11, whereby the correction sheet 19 is simultaneously separated from the recording medium 11.

The error image 4 is transferred to the correction sheet 19 when it has passed by the peeling member 21, whereby correction is accomplished.

When sufficient correction is not accomplished by a single operation, the above operation can be repeated as desired.

Thus, the temperature condition and the timing of peeling for the correction sheet may be charged from those for the ordinary recording to effect appropriate correction through temperature control of the thermal head 13 by the heater 17 and the action of the projectable peeling member 21. Further, by preheating the correction sheet with the heater 17, it becomes possible to remove the influence of the environmental temperature on the performance of the correction sheet. Further, by heating the thermal head 13 with the heater 17, the heat load of the heating element **13*b* can be decreased to improve the durability of the thermal head 13**.

As described hereinabove, in the correction sheet according to the present invention, a separation prevention layer comprising a thermoplastic resin is inserted as a part of an adhesive layer between a support and an upper adhesive layer, and the separation prevention layer is in charge of substantial part of the cohesion strength, intimate adhesion to the support and flexibility, respectively under heating, of the adhesive layer. For this reason, according to the correction sheet of the present invention, correction of an error image can be adequately conducted free from reverse transfer and even with respect to an error image formed on a recording medium with poor surface smoothness through sufficient following or fitting to the surface unevenness.

What is claimed is:

1. A correction sheet comprising an adhesive layer disposed on a support so that the adhesive layer develops an adhesive force on heating sufficient to adhere onto an erroneously recorded image on a recording medium and upon peeling to remove the erroneously recorded image from the recording medium; wherein the adhesive layer comprises a separation prevention layer comprising a thermoplastic resin having a glass transition temperature of −40° to 30° C. and an upper layer developing an adhesion on heating and containing a resin having a glass transition temperature of 60° C. or higher in a proportion of 1-25wt %.

2. A correction sheet according to claim 1, wherein said thermoplastic resin has a glass transition temperature of −30° to 15° C.

3. A correction sheet according to claim 1, wherein said thermoplastic resin has a weight-average molecular weight of $10^4$ or more.

4. A correction sheet according to claim 3, wherein said thermoplastic resin has a weight-average molecular weight of $5\times10^4$ or more.

5. A correction sheet according to claim 1, wherein the resin contained in said upper layer is selected from the group consisting of polyvinyl alcohol, polyvinyl butyral, and polyvinylpyrrolidone.

6. A correction sheet according to claim 1, wherein said upper layer contains a resin having a glass transition temperature of 80° C. or higher in a proportion of 1-10 wt. %.

7. A correction sheet according to claim 6, wherein the resin contained in said upper layer is selected from the group consisting of polyvinyl alcohol, polyvinyl butyral, and polyvinylpyrrolidone.

8. In a correction method for correcting a recorded image on a recording medium formed by superposing a transfer ink sheet on the recording medium, heating the transfer ink sheet in a pattern with a thermal head and separating the transfer ink sheet from the recording medium to leave recorded ink images on the recording medium wherein a correction sheet having an adhesive layer on a support is heated sufficiently with the thermal head, caused to adhere to an erroneously recorded image among the ink images on the recording medium and then separated from the recording medium to peel the erroneously recorded image from the recording medium; the improvement wherein the adhesive layer of the correction sheet comprises a separation prevention layer comprising a thermoplastic resin having a glass transition temperature of −40° to 30° C. and an upper layer developing an adhesion on heating and containing a resin having a glass transition temperature of 60° C. or higher in a proportion of 1-25 wt. % disposed in that order on the support; the positions of the separation of the correction sheet and the transfer ink sheet relative to the thermal head are made different from each other by the action of a peeling member movable toward and away from the recording medium; and the correction sheet is preliminarily heated prior to its contact with the erroneously recorded image and then further heated so as to adhere to the erroneously recorded image.

* * * * *

UNITED STATES PATENT AND TRADEMARK OFFICE

CERTIFICATE OF CORRECTION

PATENT NO. : 4,883,379

DATED : November 28, 1989

INVENTOR(S) : Fukuda, et al.

It is certified that error appears in the above-identified patent and that said Letters Patent is hereby corrected as shown below:

COLUMN 5,
Line 44, change "despersant," to --dispersant,--.

COLUMN 7,
Line 28, change "($T_g$ = X 33°" to --($T_g$ = +33°--.

COLUMN 9,
Line 27, change "Bekk:" to --Bekk--; and
Line 28, change "smothness" to --smoothness--.

COLUMN 10,
Line 12, change "summerized" to --summarized--.

COLUMN 11,
Line 51, change "charged" to --changed--.

Signed and Sealed this

Twenty-first Day of May, 1991

*Attest:*

HARRY F. MANBECK, JR.

*Attesting Officer*

*Commissioner of Patents and Trademarks*